United States Patent [19]

Harrison

[11] 4,288,088

[45] Sep. 8, 1981

[54] BRAKE ASSEMBLY FOR SKATEBOARD

[76] Inventor: William H. Harrison, P.O. Box 8863, Kansas City, Mo. 64109

[21] Appl. No.: 27,872

[22] Filed: Apr. 6, 1979

[51] Int. Cl.[3] ..... A63C 17/14

[52] U.S. Cl. ..... 280/87.04 A; 280/11.2

[58] Field of Search ..... 280/11.2, 87.04 A, 11.1 R, 280/11.1 BT; 15/246

[56] References Cited

U.S. PATENT DOCUMENTS

| | | | |
|---|---|---|---|
| 2,027,487 | 1/1936 | Means | 280/11.2 |
| 2,046,384 | 7/1936 | Katcher | 15/246 X |
| 3,954,279 | 5/1976 | Guerr | 280/11.19 |
| 4,003,582 | 1/1977 | Maurer | 280/11.2 |
| 4,084,831 | 4/1978 | Akonteh et al. | 280/11.2 |
| 4,099,734 | 7/1978 | Lowery | 280/11.2 |

FOREIGN PATENT DOCUMENTS

| | | | |
|---|---|---|---|
| 2721927 | 11/1978 | Fed. Rep. of Germany A | 280/87.04 |

*Primary Examiner*—Joseph F. Peters, Jr.
*Assistant Examiner*—Milton L. Smith
*Attorney, Agent, or Firm*—Schmidt, Johnson, Hovey & Williams

[57] ABSTRACT

A brake assembly for skateboards which allows smooth, safe, trouble-free braking. The assembly includes a pivotal, wheel-engaging brake plate and a depressible foot-operated pedal coupled to the plate for selective shifting of the latter into frictional, braking engagement with the wheel. A pair of debris-clearing brushes are also mounted on the brake assembly and assist in braking when the pedal is depressed. A secondary, stationary brush member is also mounted adjacent the remaining wheel assembly for debris-clearing purposes.

5 Claims, 4 Drawing Figures

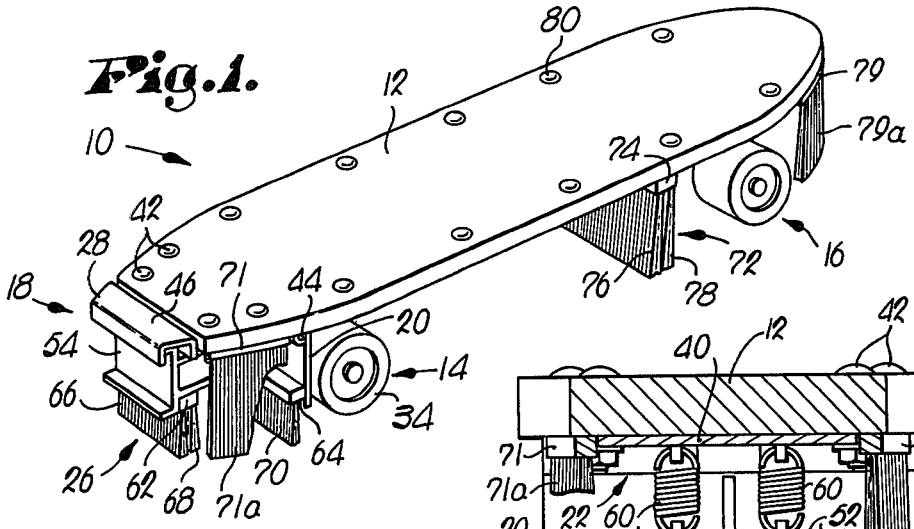
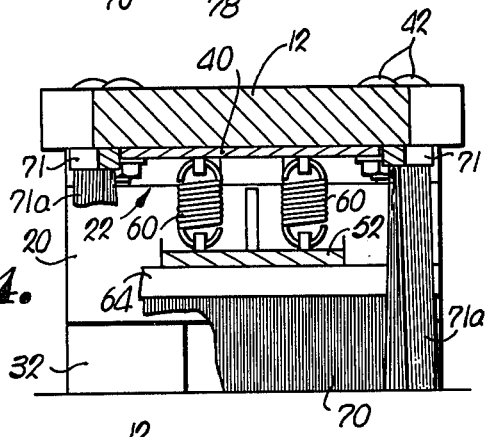
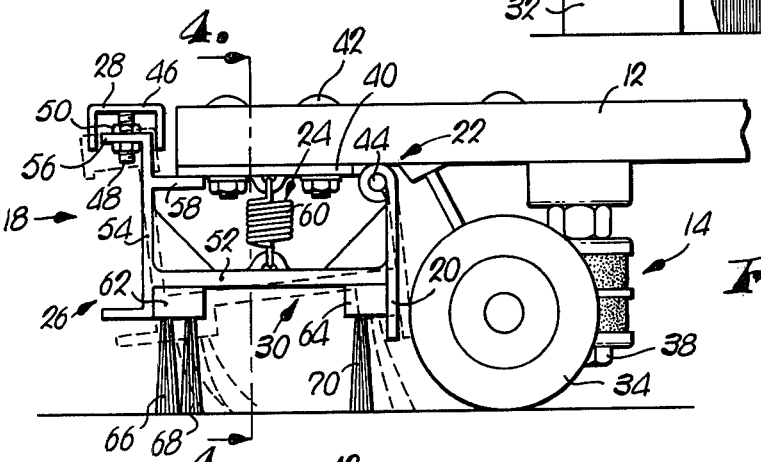
Fig.2.
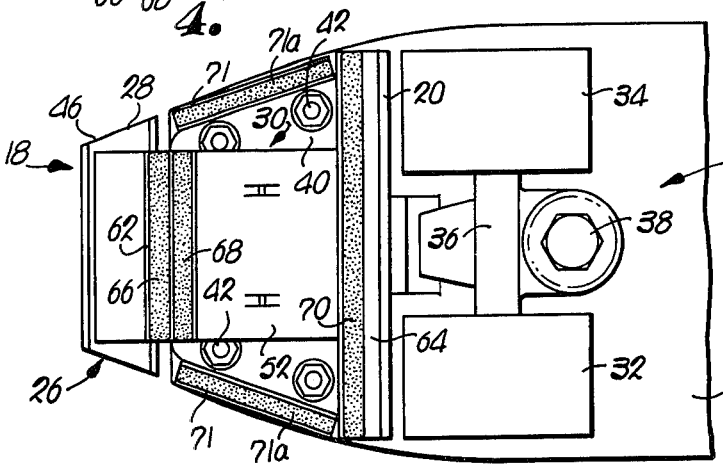

BRAKE ASSEMBLY FOR SKATEBOARD

BACKGROUND OF THE INVENTION

1. Field of the Invention

The present invention is concerned with an improved skateboard having a selectively operable brake mechanism for allowing the rider to control the speed at which he is traveling. More particularly, it is concerned with the improved skateboard wherein the brake assembly includes a shiftable, wheel-engaging brake plate, and a foot-operated, depressible pedal operatively coupled to the brake plate for shifting of the latter as desired into frictional, braking engagement with one or more wheels of the skateboard.

2. Description of the Prior Art

In recent years the popularity of skateboarding has increased dramatically, to the point where virtually all adolescents engage in the activity at one time or another. At the same time however, injuries resulting from skateboarding accidents have also risen proportionately. The cause of such accidents can of course stem from many factors, but two prime reasons are excessive, uncontrolled speed, and the instability of skateboards when debris such as rocks or the like are struck. Hence, there is a real need for an improved skateboard having a safe, smooth-acting braking assembly as a part thereof, so that the rider can control the speed at which he is traveling. Furthermore, an effective means for clearing debris from in front of the skateboard wheels would also be a real improvement.

SUMMARY OF THE INVENTION

The above problems are in large measure overcome by the present invention. Specifically, the invention contemplates the provision of a braking assembly which can be mounted on an otherwise conventional skateboard in order to give the rider a measure of speed control. Broadly speaking, the brake assembly of the invention includes a shiftable, wheel-engaging brake plate, and a foot-operated pedal mounted for selective depression by the rider's foot. The pedal is operatively coupled to the brake plate such that upon depression of the pedal the plate is moved into frictional, braking-engagement with one or more of the wheels of the skateboard.

In addition, elongated, downwardly extending, yieldable debris-clearing elements such as brushes are preferably mounted adjacent the wheel assemblies of the skateboard for clearing away gravel and other debris as the skateboard traverses a selected path of travel. Preferably, the brushes adjacent the brakable wheel assembly are mounted on the coupling member between the brake pedal and plate; accordingly, upon depression of the pedal, the brushes are shifted as well, so that the brushes assist in braking.

BRIEF DESCRIPTION OF THE DRAWING

FIG. 1 is a perspective view of a skateboard in accordance with the invention;

FIG. 2 is a fragmentary side view illustrating in detail the construction and operation of the brake assembly;

FIG. 3 is a fragmentary bottom view further illustrating the construction of the brake assembly; and FIG. 4 is a vertical sectional view taken along line 4—4 of FIG. 2 and with parts broken away for clarity.

DESCRIPTION OF THE PREFERRED EMBODIMENT

Turning now to the drawing, a skateboard 10 is illustrated in FIG. 1 which includes an elongated, rider-supporting board 12 along with a pair of spaced, conventional wheel assemblies 14 and 16 secured to the underside of board 12. Wheel assembly 14 in the illustrated embodiment is the front wheel assembly, whereas assembly 16 is the rear wheel assembly.

Brake assembly 18 in accordance with the invention is mounted adjacent front wheel assembly 14 and broadly includes a substantially planar brake plate 20, means broadly referred to by the numeral 22 for shiftably supporting the plate 20 for movement of the plate between a braking position and a non-braking position as will be described, biasing means 24 for urging the plate 20 to the non-braking position thereof, and operating means 26 including a pedal 28 and means 30 for coupling the pedal 28 and plate 20.

Referring now to FIG. 3, it will be seen that wheel assembly 14 includes a pair of laterally spaced wheels 32, 34, an axle 36, and a bolt 38 for mounting the assembly 14 onto the board 12. In addition, it will be seen that the plate 20 is of generally rectangular configuration and is of sufficient length to span the distance between the wheels 32, 34, such that the plate 20 can simultaneously engage these wheels during braking.

Supporting means 22 include a somewhat trapezoidal mounting plate 40 secured to the underside of board 12 adjacent the front end thereof and held in place by a series of bolts 42. It is noted in this respect that the heads of the bolts 42 project above the upper surface of the board 12; and the significance of this will be explained hereinafter. Plate 20 depends from mounting plate 40, and is pivotally coupled to the latter by means of a transversely extending pivot pin 44. Hence, plate 20 is pivotal about a substantially horizontal axis defined by the pin 44.

Pedal 28 is in the form of an elongated, U-shaped metallic channel 46 which is disposed adjacent to the forwardmost edge of the board 12 and at substantially the same horizontal level as the upper surface of the latter. A depending, threaded stud 48 is secured to the underside of channel 46, and has a pair of adjustment nuts 50 threaded thereon.

Coupling means 30 includes an integral, somewhat L-shaped member having a horizontal stretch 52 and a vertical stretch 54. The rearmost end of horizontal stretch 52 is welded to the face of plate 20 remote from the wheels 32, 34 (see FIG. 2), whereas the uppermost end of stretch 54 is provided with a transversely extending apertured tab 56. As illustrated, the stud 48 extends through the aperture in the tab 56, and the nuts 50 are employed to lock the tab, and thereby the entire L-shaped plate, in a desired position on the stud 48. An elongated, transversely extending stop member 58 is likewise secured to stretch 54 but extends in an opposite direction relative to the tab 56. Stop member 58 is adapted to engage the lower surface of the mounting plate 40 as best seen in FIG. 3.

Biasing means 24 is preferably in the form of a pair of laterally spaced helical springs 60 which are respectively coupled between mounting plate 40 and upper surface of the stretch 52. As will be readily appreciated, springs 60 serve to bias plate 20 out of engagement with the wheels 32, 34.

The underside of horizontal stretch 52 is provided with a pair of spaced, laterally extending brush holders 62 and 64. The holder 62 is mounted adjacent the forward end of stretch 52, and is adapted to hold a pair of transversely extending, depending brush elements 66 and 68. Likewise, the spaced holder 64 is configured to secure a transversely extending brush element 70. As best seen in FIG. 3, the elements 66, 68 are of lesser length than the element 70, and the latter is essentially the same length as the plate 20.

An additional pair of brush holders 71 are respectively secured to the underside of board 12 and extend along the converging front margins thereof as best seen in FIGS. 1 and 3. Each holder 71 supports a depending, yieldable, debris-clearing brush 71*a*.

A secondary, stationary brush member 72 is mounted adjacent and in front of the wheels of rear wheel assembly 16 (FIG. 1). Preferably, a transversely extending holder 74 is secured to the underside of board 12 and secures in place a pair of stationary, depending brushes 76, 78.

Finally, an arcuate brush holder 79 is secured to the underside of the normally rearward end of board 12, and is configured to follow the contour of the latter. A transversely arcuate, depending, yieldable debris-clearing brush 79*a* is supported by the holder 79 in a manner similar to the above-described brushes.

In the use of skateboard 10, the rider places his feet on the upper surface of board 12 and rides in the altogether conventional fashion. In the event that the rider wishes to slow his travel, it is only necessary to depress pedal 28 with his leading foot. This in turn shifts the pedal 28 downwardly and ultimately causes a brake plate 20 to be pivoted in a counterclockwise direction as viewed in FIG. 2 against the wheels 32, 34. Additional pressure applied to the pedal 28 of course increases the frictional engagement between the rear surface of plate 20 and the wheels of assembly 14. It will also be noted that this shifting of the pedal and brake plate is in opposition to the bias exerted by the springs 60. Thus, when the rider removes his foot from pedal 28, springs 60 act to return the plate to its normal, non-braking position in spaced relationship to the wheels 32, 34. This non-braking position is shown in bold lines in FIG. 2, whereas the braking position is illustrated in phantom. Also, it will be appreciated that the pedal 28 will return to its normal position when foot pressure is relieved.

During normal travel of skateboard 10, the brush elements 66, 68, 70, 71*a* and 72, serve to clear away any debris such as gravel or the like from the front of the wheels of the respective wheel assemblies. Thus, during such travel, a rider can be assured that accident-causing debris is removed from possible interference with the skateboard wheels. However, by virtue of the fact that the elements 66, 68 and 70 are shiftably mounted on the brake assembly 18, depression of the pedal 28 causes the brush element to more firmly engage the roadway, and this in turn assists in the desired braking function.

Furthermore, in the event that the user wishes to travel with the arcuate, normally rearward end of board 12 leading, brush 79*a* likewise protects against interference from debris. In this use, the brake mechanism is of course actuated by the rear foot of the user.

As discussed above, the heads of the bolts 42 project above the upper surface of board 12. This is advantageous inasmuch as the rider can feel these projecting bolt heads as his leading foot slides forwardly on the board 12 to depress the pedal 28. Thus, a tactile indication of the proximity of pedal 28 is given to the rider, by virtue of these projecting bolt heads. In like manner, additional projections or bolt head 80 can be provided about the entire periphery of board 12 for a similar purpose.

Having thus described the invention, what is claimed as new and desired to be secured by Letters Patent Is:

1. A brake assembly for a skateboard having a rider-supporting board and spaced front and rear wheel assemblies secured to said board, said brake assembly comprising:

a brake plate;

means shiftably supporting said plate adjacent one of said wheel assemblies for movement of the plate between a braking position wherein the plate is in frictional engagement with a wheel of said one assembly, and a non-braking position wherein the plate is out of engagement with said wheel;

means for biasing said plate to the non-braking position thereof;

operating means including a pedal disposed for depression by a rider standing on said board and means operatively coupling said pedal and plate for movement of the plate to the braking position thereof when said pedal is depressed; and at least one ground-engaging brush element secured to said coupling means adjacent and in front of said wheel for clearing debris ahead of the wheel and for, when said pedal is depressed, assisting in the braking of said skateboard.

2. The brake assembly as set forth in claim 1 wherein said supporting means comprises structure for mounting said plate for pivoting movement about a generally horizontal axis.

3. The brake assembly as set forth in claim 1 including means for adjusting the length of travel of said plate in the shifting thereof between said braking and non-braking positions.

4. The brake assembly as set forth in claim 1 including a stationary brush member mounted adjacent the other of said wheel assemblies for clearing debris ahead of the wheels thereof.

5. The brake assembly as set forth in claim 1 including upstanding projections adjacent said pedal for indicating to the rider the proximity of the pedal to the rider's foot.

* * * * *